United States Patent [19]

Bianchi

[11] 3,996,866

[45] Dec. 14, 1976

[54] UPPER THREAD TENSION ADJUSTING ASSEMBLY WITH AUTOMATIC RELEASE DEVICE

[75] Inventor: Nereo Bianchi, Pavia, Italy

[73] Assignee: Necchi S.p.A., Pavia, Italy

[22] Filed: Apr. 9, 1975

[21] Appl. No.: 566,277

[30] Foreign Application Priority Data

May 6, 1974 Italy ..... 42904/74

[52] U.S. Cl. ..... 112/254

[51] Int. Cl.[2] ..... D05B 47/04

[58] Field of Search ..... 112/254, 59, 97; 242/147 R, 147 M, 150 M, 156; 57/58.86

[56] References Cited

UNITED STATES PATENTS

| | | | |
|---|---|---|---|
| 2,698,590 | 1/1955 | Garbe | 112/254 |
| 3,150,846 | 9/1964 | Laidig | 112/254 X |
| 3,410,071 | 11/1968 | Heimes | 57/58.86 X |
| 3,601,074 | 8/1971 | Von Hagen | 112/254 X |
| 3,797,426 | 3/1974 | Von Hagen | 112/254 |
| 3,927,631 | 12/1975 | Kuhar | 112/254 |

FOREIGN PATENTS OR APPLICATIONS

| | | | |
|---|---|---|---|
| 1,219,825 | 12/1959 | France | 112/254 |
| 1,485,162 | 9/1965 | Germany | 112/254 |

*Primary Examiner*—Werner H. Schroeder
*Assistant Examiner*—Moshe I. Cohen
*Attorney, Agent, or Firm*—Stevens, Davis, Miller & Mosher

[57] ABSTRACT

A device for automatic tension release in an upper thread tension adjusting assembly which includes a drive shaft, actuating the detachment of the tension disks of said adjusting device, characterized in that said drive member is built in the thread tension adjusting device and is made by an electromagnet placed in a circular crown arranged between the tension disks and the adjusting knob.

1 Claim, 1 Drawing Figure

UPPER THREAD TENSION ADJUSTING ASSEMBLY WITH AUTOMATIC RELEASE DEVICE

Figure 1:
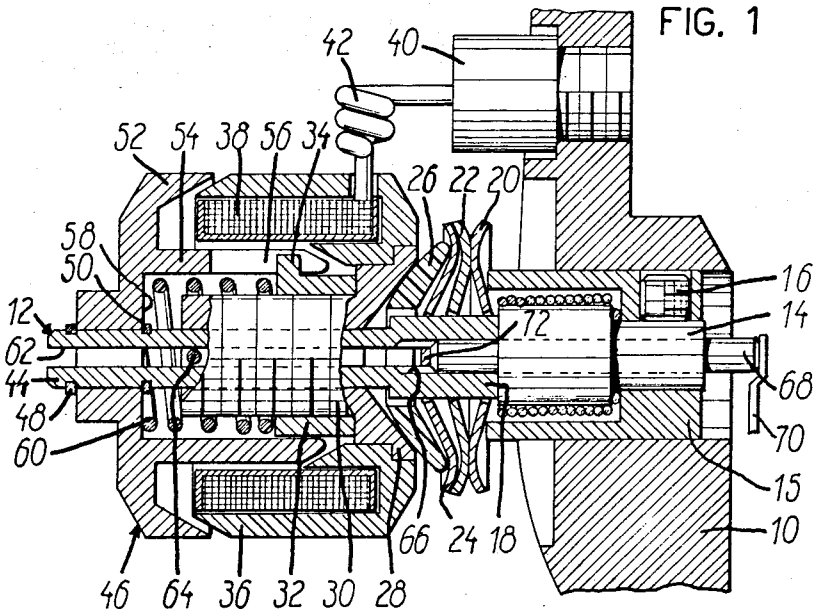

The present invention relates to an upper thread tension regulating assembly with an automatic release device of a new design, which may be applied to industrial sewing machines and is provided with a driving member causing detachment of the tension disks of the adjusting device.

The device eliminates upper thread tension through an automatic drive in cooperation with a predetermined step of sewing cycle, at the end of the sewing cycle. Similar devices already known in the art utilize a driving electromagnet for the tension release, separated from the body of the thread tension adjusting device. They required a precise setting up, have extensive overall whole dimensions and are not compact.

An object of the present invention is to provide a device for releasing upper thread tension which is, compact, easy to set up and with rather small dimensions.

The technical problem to be solved to attain this purpose, was to cause a driving member to act directly on the tension adjusting device without involving intermediate driving members.

The solution of the technical problem is characterized in that the driving member is built into the tension adjusting device and is formed by an electromagnet placed into a circular crown placed between tension disks and the adjusting knob.

Further advantages and characteristics will be apparent from the following description and from the enclosed drawing in which a preferred embodiment of the device is shown in sectional view. A thread tension adjusting assembly is fastened to the front portion of a sewing machine head shown in the figure and indicated with numeral 10.

The tension release device, object of the present invention has been made out in the assembly forming one only body therewith. The assembly is formed by a mounting shaft 12 fixed at its end 14 to bushing 15 which, in turn, is locked to portion 10 of the sewing machine head in a usual way and not shown in the drawing.

Shaft 12 carries, on its central portion, two tension disks 20 and 22 and a thrust ring 24. Ring 24 contacts plastic member 26 lying in a spherical seat made out in a body 28, which is centrally hollow, axially slidable along shaft 12 and has a threaded portion 30.

Threaded nut 32 having a key 34 is screwed onto threaded portion 30. Circular crown 36 is fixed to body 28. Into crown 36 copper thread coil 38 is placed whose terminals are fixed to a clamp 40 made out in the head of the sewing machine. Between the coil terminals and clamp 40 wires form a spiral 42 the function of which will be disclosed hereinafter.

Shaft 12 carries on its free end 44 a swivel knob 46. Swivel knob 46 is axially fixed to shaft 12 by means of two circlips 48 and 50 and has an annular portion 52 and a bushing 54 of a lesser diameter than portion 52 with an axial slit 56 for coupling with key 34 on thread nut 32.

A coil spring 60 has its seat between inner wall 58 of knob 46 and threaded nut 32.

Knob 46 cannot be displaced axially relative to shaft 12, but only rotated about it. Body 28 and circular crown 36, to the contrary, can move along the axis of shaft 12 but not rotate thereabout.

For this purpose, the portion 44 of shaft 12, furthest from the sewing machine head, has an axial slit 62 wherein a pin 64 is provided inside threaded portion 30. The adjustment of the upper thread tension is obtained by rotating knob 46 about shaft 12 which will rotate threaded nut 32 to screw on the threaded portion 30 of body 28. This threading will cause loading of spring 60 to vary on the same body 28, through plastic member 26, to disks 20 and 22.

According to the present invention, coil 38 is energized in order to remove upper thread tension during an automatic sewing cycle, as it must occur, for example before the thread cutter blades actuate. A magnetic field is created between the outer portion of knob and circular crown 36 also of magnetic material which draws crown 36 toward knob 46 of magnetic material.

Crown 36 is free to move axially. On the contrary knob 46 cannot displace axially as it is restrained in this movement by circlips 48 and 50. Spiral 42 allows the terminals of copper thread coil 38 to follow circular crown axial movement. Body 28 is made of non-magnetic material to avoid any leak of the flux lines closing between crown 36 and knob 46. With energization, the pressure between disks is removed so that the thread is no longer biased. According to the usual working of the lower thread tension adjusting devices, the upper thread tension is eliminated upon lifting of the presser foot. For this purpose a hole 66 is centrally drilled into a portion 18 of shaft 12, and a pin 68 placed into hole 66.

One end of pin 68 contacts end portion 70 of a kinematic chain, not shown, connecting presser bar to the tension adjusting device. The opposite end of pin 68 contacts central portion 72 of a thrust ring placed inside shaft 12.

I claim:

1. A device for automatic tension release in an upper thread tension adjusting assembly comprising a mounting shaft fixed on the sewing machine head, a centrally hollow body axially slidable along said shaft and being externally threaded, tension discs mounted on said shaft between a fixed portion of said sewing machine head and said axially slidable body, an internally threaded nut placed onto the threaded portion of said body, a circular crown of magnetic material fixedly strictly secured to said body, a knob of magnetic material having an inner wall rotatably mounted on said shaft and axially fixed relative to the same, a coil spring placed between said inner wall of said knob and said threaded nut; a copper thread coil placed in said circular crown energizable at a predeterminated time in order to create a magnetic field and an attraction force between said knob and said circular crown against the action of said coil spring.

* * * * *